US011883707B2

(12) United States Patent
Hong

(10) Patent No.: US 11,883,707 B2
(45) Date of Patent: Jan. 30, 2024

(54) WEIGHT-ADJUSTABLE DUMBBELL AND DUMBBELL ASSEMBLY

(71) Applicant: Guonian Hong, Zhejiang (CN)

(72) Inventor: Guonian Hong, Zhejiang (CN)

( * ) Notice: Subject to any disclaimer, the term of this patent is extended or adjusted under 35 U.S.C. 154(b) by 115 days.

(21) Appl. No.: 17/480,362

(22) Filed: Sep. 21, 2021

(65) Prior Publication Data

US 2022/0347512 A1 Nov. 3, 2022

(30) Foreign Application Priority Data

Apr. 30, 2021 (CN) ..... 202120940363.9

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC .... A63B 21/00058–00065; A63B 21/072–075
See application file for complete search history.

(56) References Cited

U.S. PATENT DOCUMENTS

| | | | | |
|---|---|---|---|---|
| 7,553,265 | B2 * | 6/2009 | Crawford | A63B 21/0728 482/93 |
| 7,614,982 | B2 * | 11/2009 | Crawford | A63B 21/075 482/107 |
| 9,776,032 | B2 * | 10/2017 | Moran | A63B 24/0087 |
| 9,895,571 | B2 * | 2/2018 | Wang | A63B 21/0724 |
| 10,195,477 | B2 * | 2/2019 | Marjama | A63B 21/0728 |
| 10,518,123 | B2 * | 12/2019 | Moran | A63B 21/0726 |
| 11,478,675 | B2 * | 10/2022 | Chen | A63B 21/0728 |
| 2009/0186748 | A1 * | 7/2009 | Golesh | A63B 21/0728 482/107 |
| 2018/0169459 | A1 * | 6/2018 | Wang | A63B 21/4035 |
| 2022/0047908 | A1 * | 2/2022 | Weng | A63B 21/0726 |

* cited by examiner

*Primary Examiner* — Loan B Jimenez
*Assistant Examiner* — Kathleen M Fisk

(57) ABSTRACT

The present application relates to the field of sports equipment, in particular to a weight-adjustable dumbbell and a dumbbell assembly. The weight-adjustable dumbbell comprises a dumbbell grip bar assembly and dumbbell plate groups connected to two ends of the dumbbell grip bar assembly; each dumbbell plate group comprises at least two dumbbell plates; the dumbbell grip bar assembly comprises a rotary plate selecting mechanism used for loosening or selecting at least one dumbbell plate. The present application has the effect of conveniently adjusting the weight of the dumbbell.

16 Claims, 17 Drawing Sheets

WEIGHT-ADJUSTABLE DUMBBELL AND DUMBBELL ASSEMBLY

CROSS-REFERENCE TO RELATED APPLICATION

The present application claims the priority benefit of China application No. 202120940363.9 filed on Apr. 30, 2021. The entirety of the above-mentioned patent application is incorporated herein by reference and made a part of this specification.

TECHNICAL FIELD

The present application relates to the field of sports equipment, in particular to a weight-adjustable dumbbell and a dumbbell assembly.

BACKGROUND

The dumbbell is a common fitness equipment, and at present, the dumbbell with fixed weight and the weight-adjustable dumbbell are available on the market.

When the dumbbell with fixed weight is used, a plurality of sets of dumbbells need to be equipped to meet different requirements of fitness people; the weight-adjustable dumbbell generally comprises a central shaft, a plurality of dumbbell plates connected in series at two ends of the central shaft, and locking nuts screwed at two ends of the central shaft. Specifically, by increasing or decreasing the dumbbell plates on the central shaft, and then rotating the lock nut to adjust the position of the locking nut on the central shaft, the dumbbell plates are tightened to complete the weight adjustment of the dumbbell.

Aiming at the related art, the inventor believes that when the dumbbell weight needs to be replaced, the locking nut needs to be removed, then the dumbbell plate is installed, and the locking nut is tightened each time. The installation process is tedious and time-consuming, and it is not convenient to adjust the dumbbell weight.

SUMMARY

In order to conveniently adjust the weight of the dumbbell, the present application provides a weight-adjustable dumbbell and a dumbbell assembly.

In a first aspect, the present application provides a weight-adjustable dumbbell, which adopts the following technical solution.

A weight-adjustable dumbbell includes a dumbbell grip bar assembly and dumbbell plate groups connected to two ends of the dumbbell grip bar assembly, wherein each of the dumbbell plate groups includes at least two dumbbell plates, and the dumbbell grip bar assembly includes a rotary plate selecting mechanism for releasing or selecting at least one dumbbell plate.

By adopting the technical scheme, different dumbbell plate groups can be selected by rotating the rotary plate selecting mechanism, the locking nut does not need to be dismantled firstly, then the dumbbell plate is installed, and then the locking nut is screwed down, so that the weight of the dumbbell can be conveniently adjusted. In addition, the dumbbell grip bar assembly has certain weight, so that no-load training can be carried out.

Optionally, a plurality of dumbbell plates (10) in one dumbbell plate group (1) have different weights.

By adopting the technical scheme, the weight of the dumbbell can be more flexibly adjusted due to different weights of the dumbbell plates, so that the selection of the training weight is smoother.

Optionally, the rotary plate selecting mechanism includes a central shaft, a handle tube rotatably connected to the central shaft, and at least one hanging piece rotatably connected to the central shaft, the hanging piece rotates synchronously with the handle tube;

a convex block is convexly provided on the hanging piece, the convex block and the hanging piece form a limiting area and a disengaging area, the dumbbell plate is provided with a positioning block, the positioning block is able to slide into the limiting area and be buckled with the convex block, and the positioning block is able to slide into the disengaging area and be staggered with the convex block.

By adopting the technical scheme, the hanging piece and the handle tube rotate synchronously, so that the hanging piece can be driven to rotate when the handle tube is rotated. The convex blocks convexly provided on the two end faces of the hanging piece can be positioned in the limiting area or the disengaging area of the dumbbell plate through rotation of the hanging piece; when the convex block slides into the limiting area, the convex block is buckled with the positioning block, namely the hanging piece and the dumbbell plate are relatively locked, and the dumbbell plate can be lifted along with the hanging piece; when the convex block slides into the disengaging area, the convex block and the positioning block are staggered, namely the hanging piece and the dumbbell plate are unlocked relatively, and the dumbbell plate cannot be lifted along with the hanging piece. Therefore, the combination of the required dumbbell plates can be selected through the rotation of the handle tube, and the weight of the dumbbell can be conveniently adjusted.

Optionally, the dumbbell grip bar assembly (2) further includes a safety stop mechanism, the safety stop mechanism includes a stop disc and a lock head, the stop disc rotates relative to the central shaft, the stop disc rotates synchronously with the handle tube, and the lock head is configured for unlocking/locking rotation of the stop disc.

By adopting the technical scheme, the stop disc is linked with the handle tube and the hanging piece group, so that the stop disc, the handle tube and the hanging piece group are synchronously and rotatably connected with each other. When the lock head unlocks the stop disc to rotate, the handle tube rotates to drive the stop disc to rotate, and then the hanging piece is driven to rotate to select the required dumbbell plate; when the locking stop disc on the lock head rotates, the handle tube cannot rotate, so that the hanging piece cannot rotate, the probability that the dumbbell plate falls off due to incorrect rotation of the handle tube during training is reduced, and the training safety is improved.

Optionally, the safety stop mechanism further includes a lock case fixed with the central shaft, and a lock head slidably connected to the lock case; the stop disc is rotatably connected with the lock case, a plurality of stop blocks are arranged on one end face of the stop disc in a circumferential direction at intervals, and stop notches for inserting of the lock head are formed between adjacent stop blocks.

By adopting the technical scheme, when the lock head is inserted into the stop notch, the stop disc is locked, and the stop disc cannot rotate; when the lock head is staggered with the stop notch, the stop disc is in an unlocking state, and the stop disc can rotate.

A plurality of spaced stop blocks arranged on the stop disc form a plurality of spaced stop notches, and each time the stop disc rotates by a selected angle, the lock head can be inserted into the corresponding stop notches to complete the selection of the dumbbell plates; when the dumbbell plates need to be replaced, the stop disc can be rotated again only by touching the lock head to enable the lock head to be staggered with the stop notch to select the dumbbell plates.

Optionally, the safety stop mechanism further includes an elastic member that always forces the lock head to have a movement tendency of inserting into the stop notch.

By adopting the technical scheme, when the dumbbell is lifted to move, the elastic member can enable the lock head to be inserted into the stop notch all the time, so that the locking stability of the stop disc is further improved.

Optionally, the dumbbell grip bar assembly further includes an isolation limiting mechanism, the isolation limiting mechanism includes a connecting block and a plurality of isolating blocks, one end of the connecting block is connected with the lock case, other end of the connecting block is connected with the central shaft in a coupling manner, and the plurality of isolating blocks are convexly provided on two sides of the connecting block and are provided for separating adjacent dumbbell plates.

By adopting the technical scheme, the dumbbell plates are separated on the two sides of the isolating block, and meanwhile the dumbbell plates are limited to move by the isolating blocks on the two sides, so that the extraction stability of the dumbbell plates is improved.

In a second aspect, the present application provides a dumbbell assembly, which adopts the following technical solution.

A dumbbell assembly includes the above mentioned dumbbell and a dumbbell base for placing the dumbbell.

Optionally, the dumbbell base is convexly provided with a top block, the top block abuts against the lock head, and the lock head is staggered with the stop notch.

By adopting the technical scheme, when the dumbbell is placed on the dumbbell base, the top block convexly provided on the dumbbell base can abut against the lock head, so that the lock head and the stop notch are continuously staggered, and the stop disc is always in an unlocking state, so that the dumbbell plate can be continuously selected by rotating the handle head, and the weight of the dumbbell can be adjusted.

Optionally, the dumbbell base is convexly provided with a plurality of stabilizing blocks, and bottom of the dumbbell plate is provided with a stabilizing groove for inserting of the positioning blocks.

By adopting the technical scheme, the stabilizing block is inserted into the stabilizing groove, so that the movement of the dumbbell plate can be limited, and the placing stability of the dumbbell plate is improved.

DESCRIPTION OF THE EMBODIMENTS

The present application will be described in further detail below with reference to FIGS. 1-21.

Figure 1:
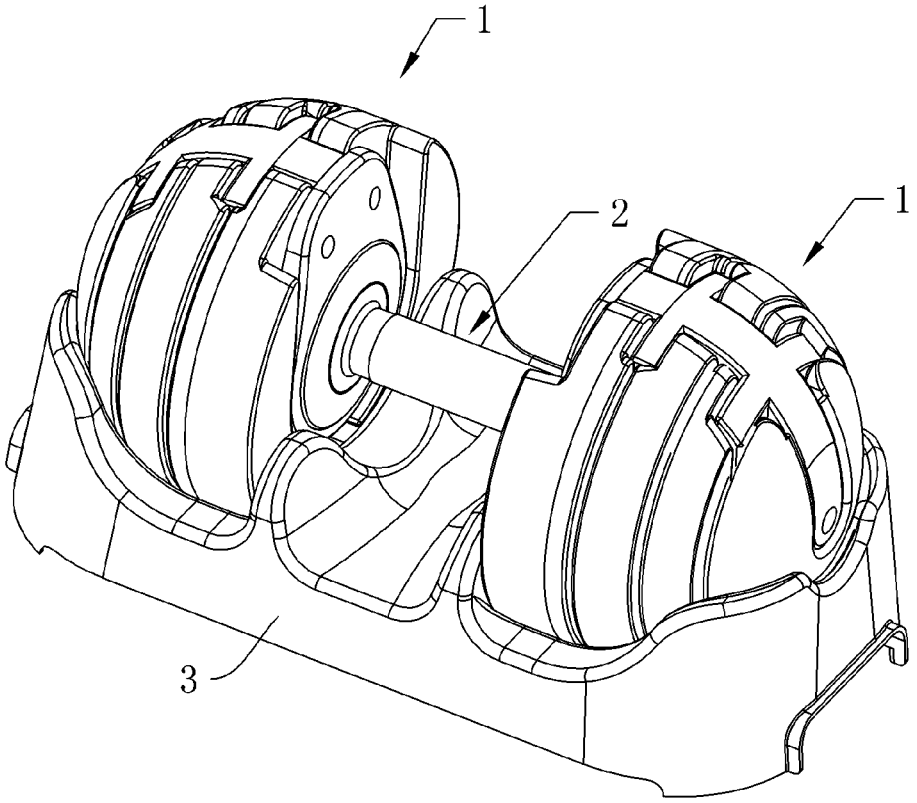
FIG. 1 is a schematic view of the overall structure of an embodiment of the present application with a dumbbell placed on a dumbbell base.

The embodiment of the present application discloses a weight-adjustable dumbbell assembly. Referring to FIG. 1, a weight-adjustable dumbbell assembly includes a dumbbell plate group 1, a dumbbell grip bar assembly 2, and a dumbbell base 3. Two dumbbell plate groups 1 are provided and are symmetrically connected to two ends of the dumbbell grip bar assembly 2.

The dumbbell plate groups 1 is positioned on the dumbbell base 3.

Figure 2:
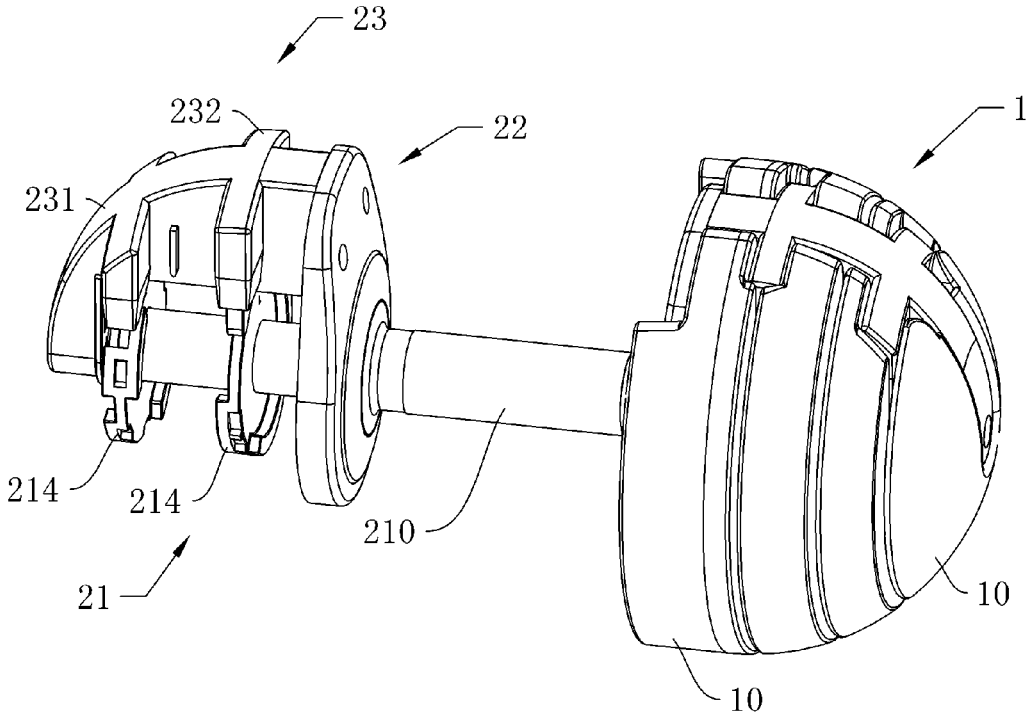
FIG. 2 is a structural schematic diagram of a dumbbell grip bar assembly and a dumbbell plate group according to an embodiment of the present application, one end of the dumbbell grip bar assembly is connected with the dumbbell plate group, and the other end of the dumbbell grip bar assembly is not connected with the dumbbell plate group.

Referring to FIG. 2, the dumbbell plate group 1 includes at least two dumbbell plates 10, and the weight of each of the dumbbell plates 10 may be the same or different. The dumbbell grip bar assembly 2 includes a rotary plate selecting mechanism 21, an isolation limiting mechanism 23 and a safety stopping mechanism 22.

The rotary plate selecting mechanism 21 includes a linkage assembly 210 and a hanging piece 214. The linkage assembly 210 and the hanging piece 214 rotate synchronously. The linkage assembly 210 is driven to rotate to drive the hanging piece 214 to further rotate for selecting a dumbbell plate 10.

Figure 3:
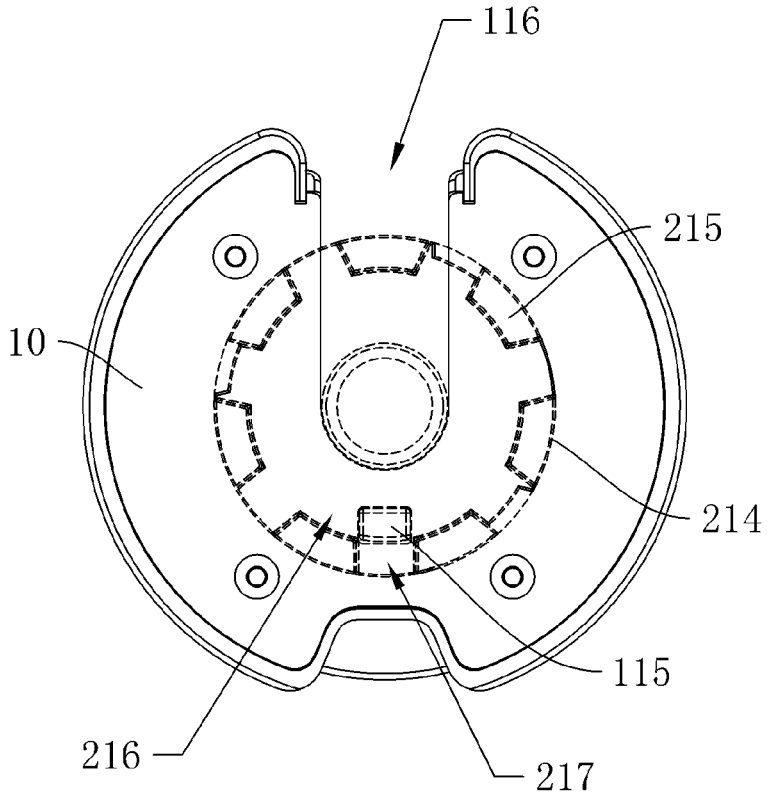
FIG. 3 is a schematic diagram showing the mating a dumbbell plate and a hanging piece according to an embodiment of the present application.

Referring to FIGS. 2 and 3, an end face of the dumbbell plate 10 is convexly provided with a positioning block 115, and an end face of the hanging piece 214 connected with the dumbbell plate 10 is convexly provided with a convex block 215 that has a sector-ring shape. The convex block 215 and the hanging piece 214 form a limiting area 216 and a disengaging area 217. Specifically, one side opposite to the inner diameter surface of the convex block 215 is a limiting area 216, and a gap between adjacent convex blocks 215 forms a disengaging area 217. By rotating the hanging piece 214, the positioning block 115 on the dumbbell plate 10 can slide into the limiting area 216 to enable the positioning block 115 to be buckled with the convex block 215, so that the hanging piece 214 and the dumbbell plate 10 can be lifted synchronously. Correspondingly, with rotating of the hanging piece 214, the positioning block 115 on the dumbbell plate 10 can slide into the disengaging area 217, such that the positioning block 115 is staggered with the convex block 215, thereby separating the hanging piece 214 with the dumbbell plate 10.

Referring to FIGS. 2 and 3, the isolation limiting mechanism 23 includes a connecting block 231, and a plurality of isolating blocks 232 convexly provided on both sides of the connecting block 231. A positioning hole 116 is formed on the upper end of the dumbbell plate 10 from top to bottom. The connecting block 231 is inserted into the positioning hole 116 so as to limit a circumferential rotation of the dumbbell plate 10. The dumbbell plates 10 are positioned between adjacent isolating blocks 232 to limit an axial movement of the dumbbell plates 10.

The vertical movement of the dumbbell plates 10 is limited by the rotary plate selecting mechanism 21, and the circumferential rotation and the axial movement of the dumbbell plates 10 are limited by the isolation limiting mechanism 23, thereby connecting the dumbbell plates 10 with the dumbbell grip bar assembly 2. Further, the rotation of the hanging piece 214 is restricted by the safety stopping mechanism 22, such that the connection stability of the dumbbell plate 10 with the dumbbell grip bar assembly 2 can be improved.

Figure 4:
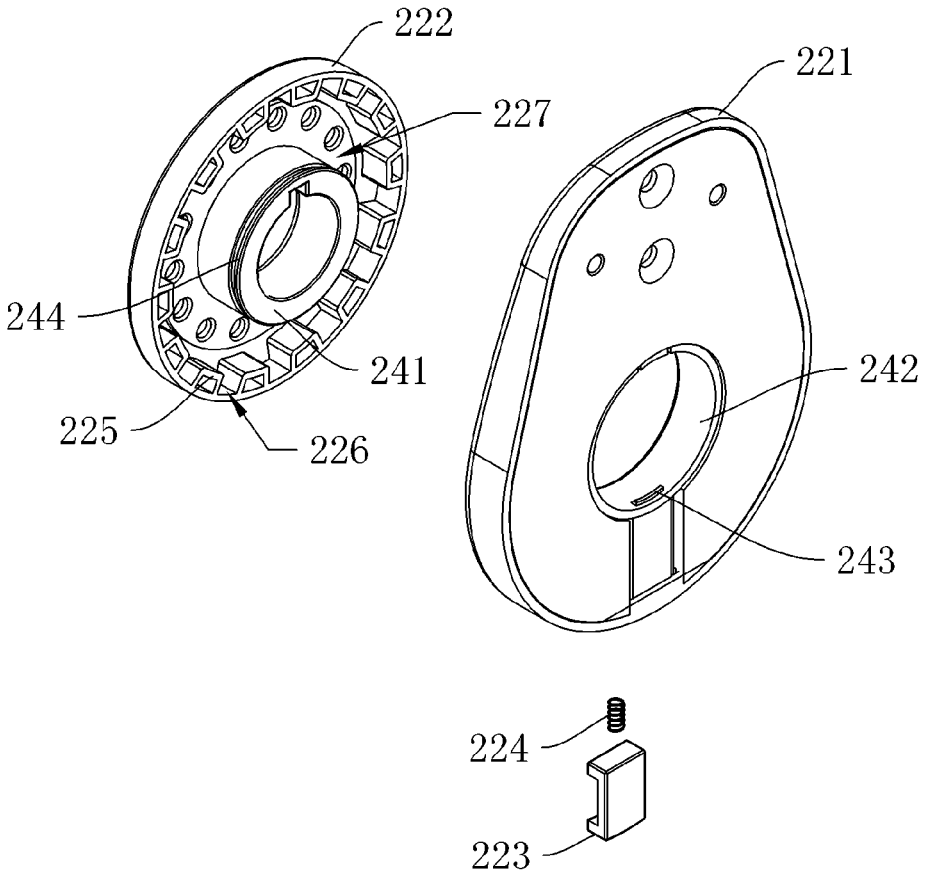
FIG. 4 is an exploded schematic view of a safety stop mechanism according to an embodiment of the present application.

Referring to FIGS. 3 and 4, the safety stop mechanism 22 includes a lock case 221 that is rotatable relative to the hanging piece 214, a stop disc 222 that is rotatable in synchronization with the hanging piece 214, a lock head 223 for unlocking/locking rotation of the stop disc 222, and an elastic member 224.

Figure 5:
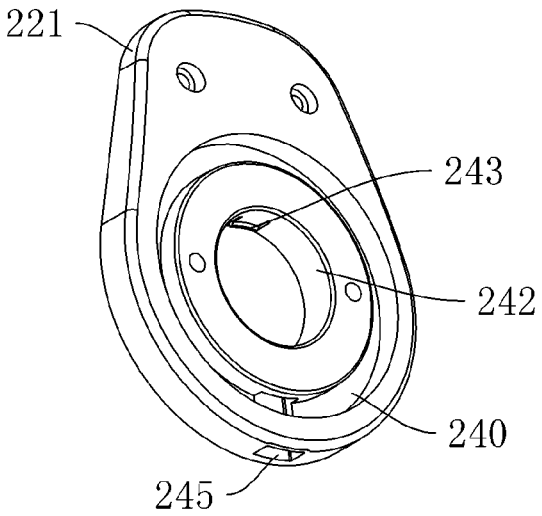
FIG. 5 is a schematic view showing the structure of a lock case according to an embodiment of the present application.

Referring to FIGS. 4 and 5, one end face of the lock case 221 is provided with an accommodating groove 240, in which the stop disc 222 is accommodated. The stop disc 222 is relatively rotatably connected to the lock case 221. A lower end of the lock case 221 is provided with a sliding groove 245 for slidably inserting of the lock head 223. The sliding groove 245 is communicated with the accommodating groove 240.

A mounting tube 241 is convexly provided in the middle of the stop disc 222. A mounting hole 242 for inserting of the mounting tube 241 is formed in the middle of the lock case 221. At least one fixture block 243, which has a certain deformation capacity, is convexly provided on the hole wall of the mounting hole 242 of the lock case 221. Correspondingly, an annular groove 244 for clamping of the fixture block 243 is provided on the periphery of the mounting tube 241. In order to improve the connection stability of the mounting tube 241 with the fixture block 243, two fixture blocks 243 are symmetrically provided in the embodiment of the present application. Additionally, it should be noted that the fixture block 243 is still able to rotate relative to the stop disc 222 along the annular groove 244, i.e., the stop disc 222 is able to rotate relative to the lock case 221.

With reference to FIGS. 4 and 5, a plurality of stop blocks 225 are uniformly provided on the stop disc 222, which are circumferentially spaced along an end face facing the lock case 221. A stop notch 226 is formed between adjacent stop block 225. In addition, it should be noted that, in the present embodiment, a stop groove 227 is provided on an end face of the stop disc 222 facing the lock case 221, and the stop blocks 225 are integrally convexly provided at intervals along the inner peripheral wall of the stop groove 227. The stop groove 227 communicates with the accommodating groove 240 when the stop disc 222 is placed in the accommodating groove 240. In another embodiment, the stop blocks 225 may be directly convexly provided on the end face of the stop disc 222 facing the lock case 221.

Figure 6:
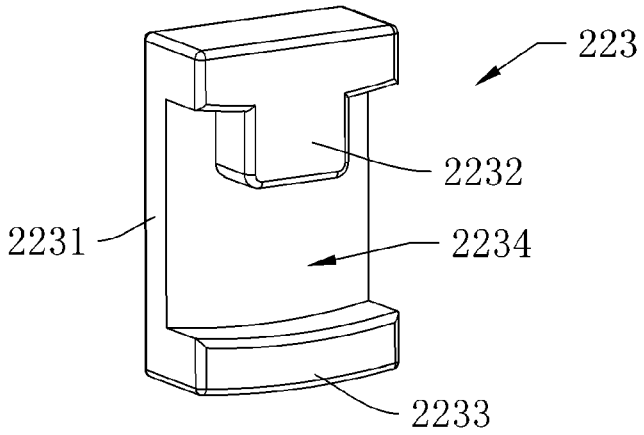
FIG. 6 is a schematic view showing the structure of a lock head according to an embodiment of the present application.

Referring to FIG. 6, the lock head 223 includes a connecting portion 2231, a T-shaped abutment portion 2232 integrally formed at the upper end of the connecting portion 2231, and a trigger portion 2233 integrally formed at the lower end of the connecting portion 2231. The lower end of the abutment portion 2232 can be inserted into the stop notch 226 so as to limit the rotation of the stop disc 222. In addition, a relief groove 2234 is formed between the abutment portion 2232 and the trigger portion 2233 to allow the stop blocks 225 to pass therethrough, so that the abutment portion 2232 is staggered with the stop notch 226, thereby allowing the stop disc 222 to freely rotate.

The elastic member 224 is preferably a compression spring. The elastic member 224 is accommodated in the sliding groove 245, one end of the elastic member 224 abuts against the groove bottom of the sliding groove 245, the other end of the elastic member 224 abuts against one end of the connecting portion 2231 to which the abutment portion 2232 is connected, and the elastic member 224 always forces the abutment portion 2232 to have a movement tendency of inserting into the stop notch 226.

Figure 7:
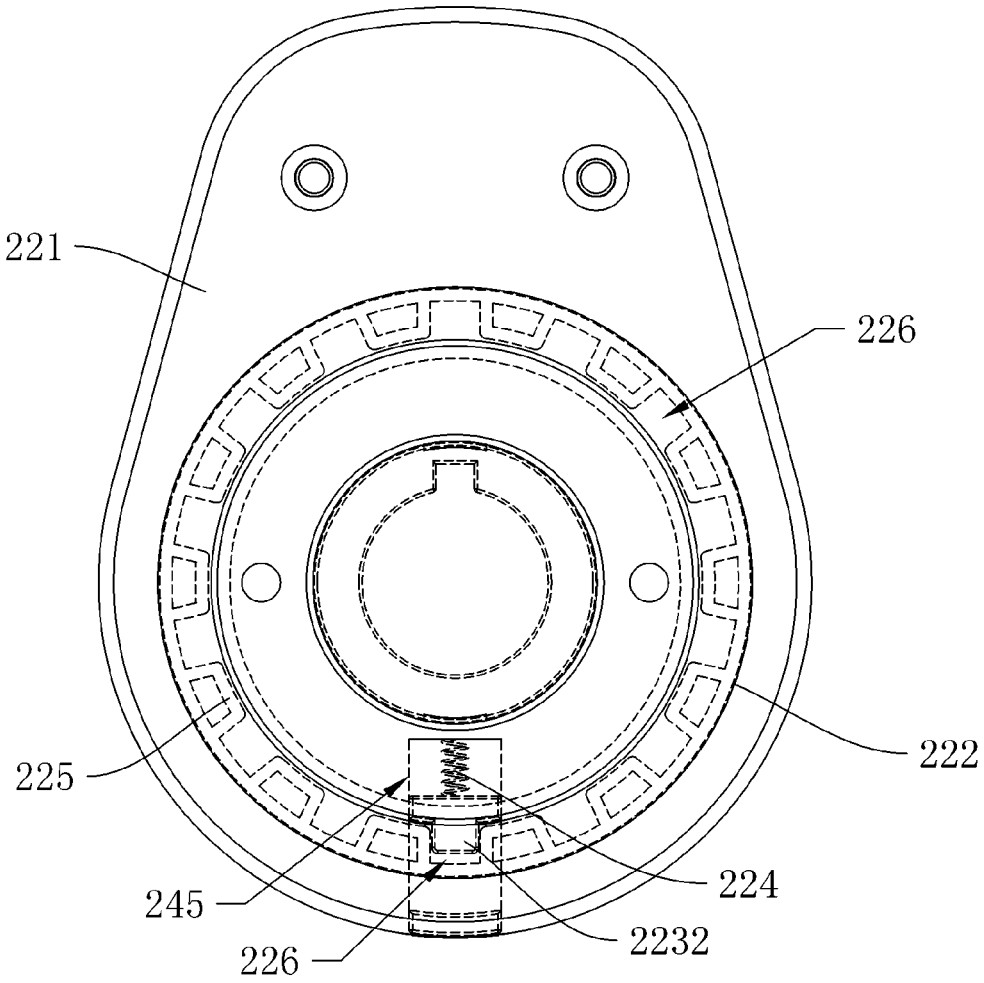
FIG. 7 is a schematic view showing the mating of the lock head and the stop disc according to an embodiment of the present application, and the stop disc is in an unlocking state.

Referring to FIG. 7, the stop disc 222 has two states of unlocking/locking depending on the cooperation of the abutment portion 2232 with the stop notch 226. When the abutment portion 2232 is inserted into the stop notch 226, the elastic member 224 is reset, such that two sides of the abutment portion 2232 are limited by two stop blocks 225 and the stop disc 222 cannot rotate, thus the stop disc 222 is in a locking state.

Figure 8:
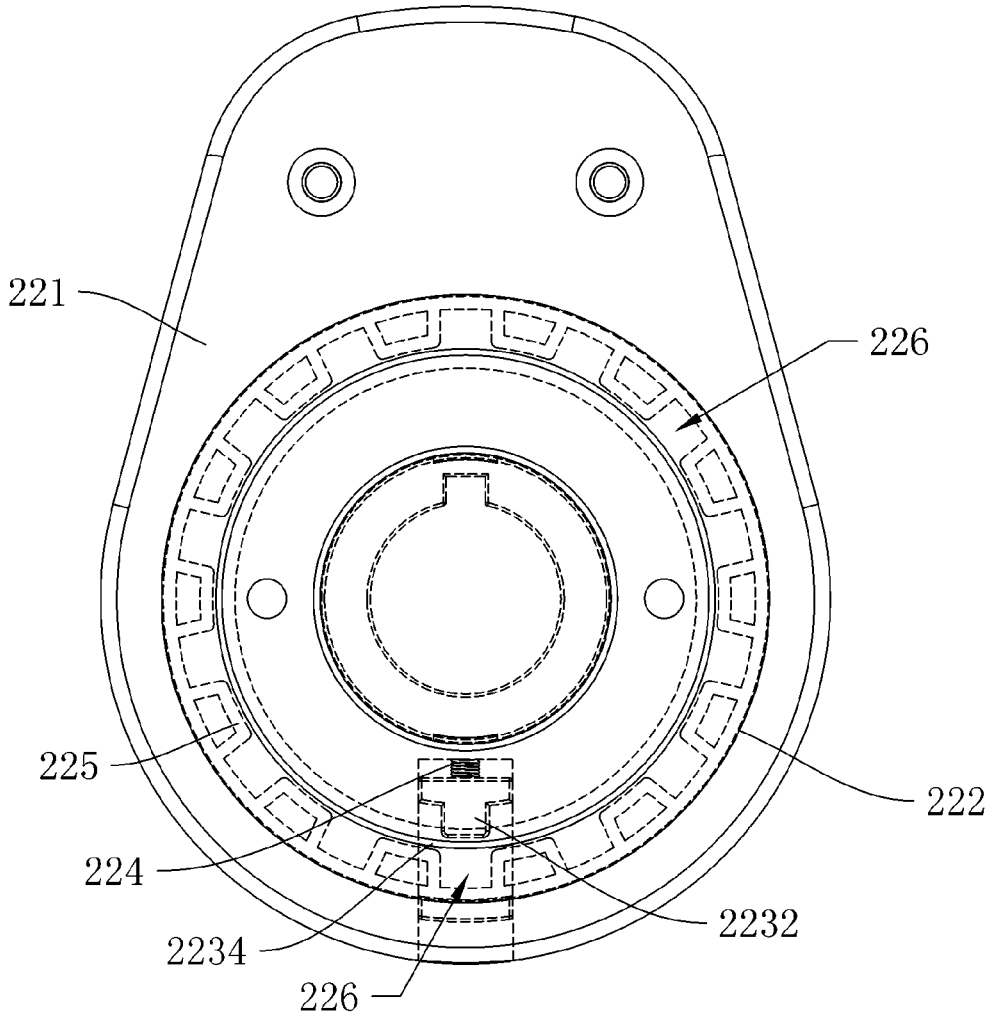
FIG. 8 is a schematic view showing the mating of the lock head and the stop disc according to an embodiment of the present application, and the stop disc is in a locking state.

Referring to FIG. 8, when the lower end of the abutment portion 2232 is staggered with the stop notch 226, the elastic member 224 is compressed, such that a rotational trajectory of the stop block 225 falls within the range of the relief groove 2234 and the stop disc 222 can be rotated again, thus the stop disc 222 is in an unlocking state.

Figure 9:
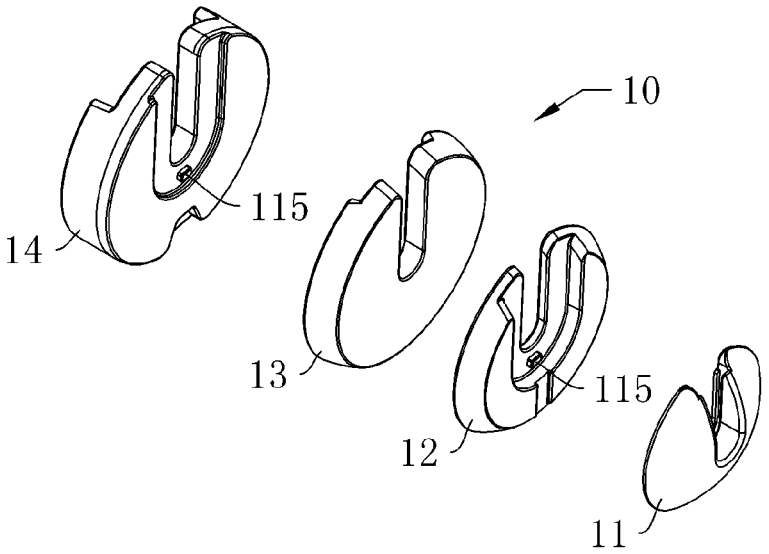
FIG. 9 is an exploded view of a dumbbell plate group according to an embodiment of the present application.
Figure 10:
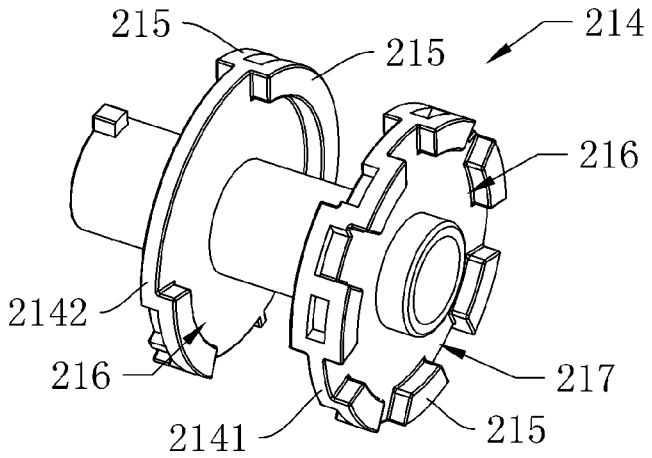
FIG. 10 is a schematic view showing the structure of a hanging piece according to an embodiment of the present application.

Specifically, referring to FIGS. 9 and 10, four dumbbell plates 10 with different weights are taken as examples in the embodiment of the present application. For convenience of explanation, four dumbbell plates 10 in one dumbbell plate group 1 are named as piece I 11, piece II 12, piece III 13 and piece IV 14 in an order from small to large in weight. Two hanging pieces 214 are provided on each side. For convenience of explanation, in a direction from piece I 11 to piece IV 14, the two hanging pieces 214 are sequentially named as a first hanging piece 2141 for selecting the piece I 11 and/or the piece II 12 and a second hanging piece 2142 for selecting the piece III 13 and/or the piece IV 14.

Figure 11:
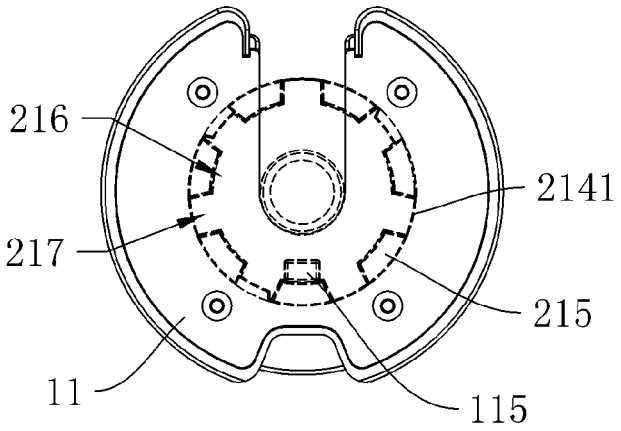
FIG. 11 is a schematic view showing the mating of piece I and the first hanging piece according to an embodiment of the present application, and the convex block of piece I is located in the limiting area.

Referring to FIG. 11, in the embodiment of the present application, seven sector-ring shaped convex blocks 215 are uniformly arranged on an end face of the first hanging piece 2141 close to piece I 11 in the circumferential direction at intervals, and the seven convex blocks 215 together with one end face of the first hanging piece 2141 form seven limiting areas 216. Correspondingly, a total of seven disengaging areas 217 are formed between the adjacent convex blocks 215. Each time the first hanging piece 2141 rotates (360/14)°, the state (buckling or staggering) of the positioning block 115 and the convex block 215 can be switched.

For example, in an initial state, in which the positioning block 115 is buckled with the convex block 215, when the first hanging piece 2141 rotates (360/14°) clockwise or anticlockwise, the positioning block 115 is staggered with the convex block 215 and slides into the disengaging area 217, and at this moment, the positioning block 115 and the convex block 215 are in a staggered state; and when the first hanging piece 2141 is lifted, piece I 11 is separated with the first hanging piece 2141; further, when the first hanging piece 2141 is rotated (360/14°) clockwise or anticlockwise such that the positioning block 115 is buckled with the convex block 215 again and slides into the limiting area 216, and at this moment, the positioning block 115 and the convex block 215 are in a buckled state; and when the first hanging piece 2141 is lifted, piece I 11 and the first hanging piece 2141 are lifted synchronously, so that the selecting of piece I 11 is finished.

Referring back to FIG. 8, it should be noted that, in the embodiment of the present application, in order to fit the arrangement of the convex blocks 215 of the first hanging piece 2141, the number of the stop blocks 225 and the stop notch 226 of the stop disc 222 is set to fourteen, and the included angle of the adjacent stop notches 226 or the adjacent stop blocks 225 is (360/14)°.

Figure 12:
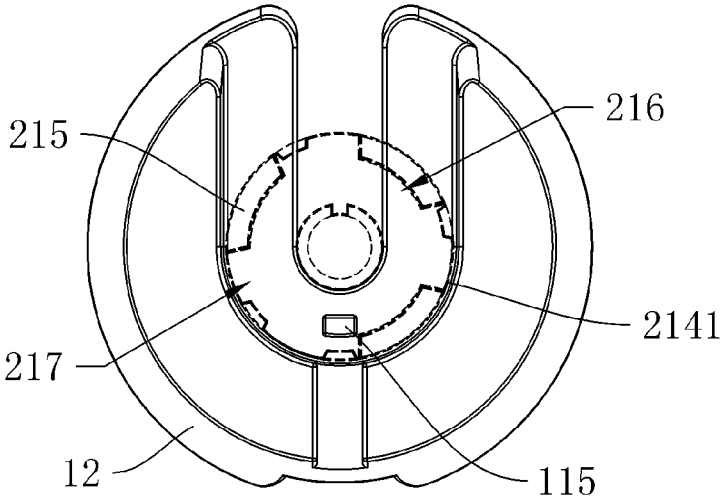
FIG. 12 is a schematic view showing the mating of piece II and the first hanging piece according to an embodiment of the present application, and the convex block of piece II is located in the disengaging area.

Referring to FIG. 12, three sector-ring shaped convex blocks 215 are arranged on an end face of the first hanging piece 2141 close to piece II 12 in the circumferential direction at intervals, and correspondingly, a total of three disengaging areas 217 are formed between adjacent convex blocks 215. Specifically, the arrangement in a counterclockwise direction includes a disengaging area 217 with a sector-ring opening angle (360/14°), a convex block 215 with a sector-ring opening angle (360/14×3°), a disengaging area 217 with a sector-ring opening angle (360/14×3°), a convex block 215 with the sector-ring opening angle (360/14×3°), disengaging area 217 with a sector-ring opening angle (360/14°) and convex block 215 with a sector-ring opening angle (360/14×3°).

Figure 13:
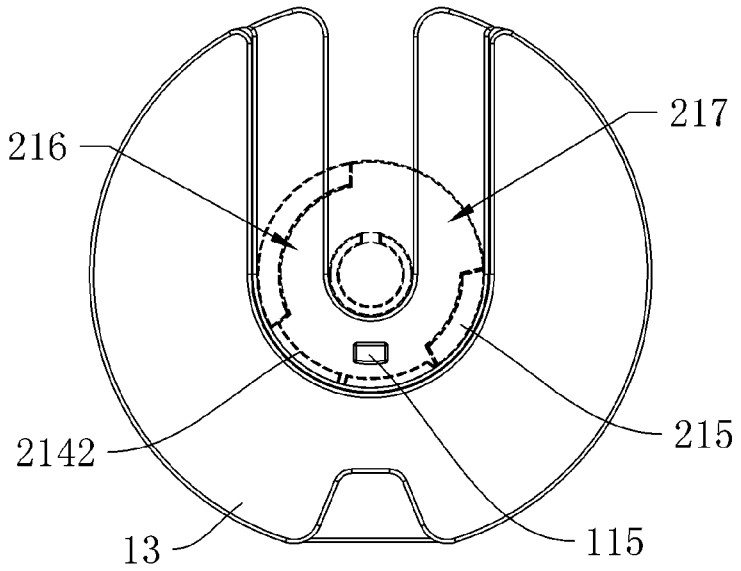
FIG. 13 is a schematic view showing the mating of piece III and the second hanging piece according to an embodiment of the present application, and the convex block of piece III is located in the disengaging area.

Referring to FIG. 13, two sector-ring shaped convex blocks 215 are arranged on an end face of the second hanging piece 2142 acting on piece III 13 in a circumferential direction at intervals, and correspondingly, a total of two disengaging areas 217 are formed between adjacent convex blocks 215. Specifically, the arrangement in a counterclockwise direction includes a convex block 215 with a sector-ring opening angle (360/14×5°), a disengaging area 217 with a sector-ring opening angle (360/14×3°), a convex block 215 with a sector-ring opening angle (360/14×3°) and a disengaging area 217 with a sector-ring opening angle (360/14×3°).

Figure 14:
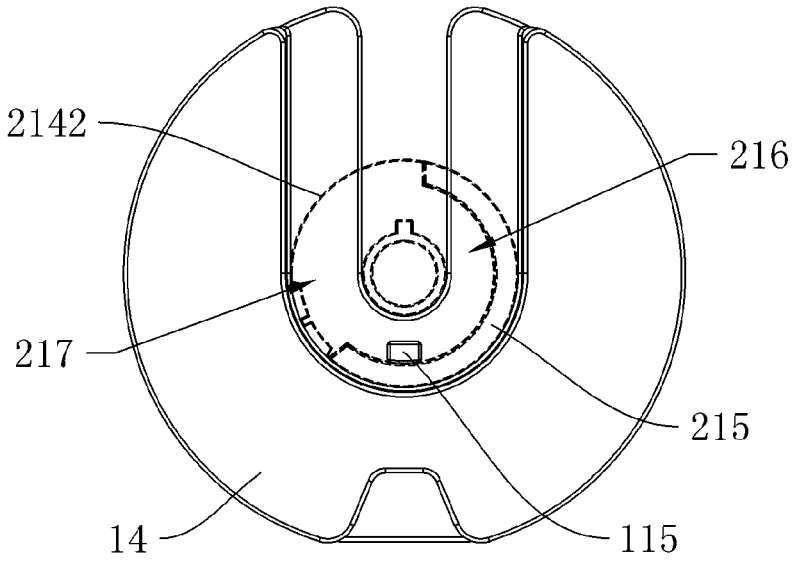
FIG. 14 is a schematic view showing the mating of piece IV and the second hanging piece according to an embodiment of the present application, and the convex block of piece IV is located in the limiting area.

Referring to FIG. 14, a sector-ring shaped convex block 215 is arranged on an end faces of the second hanging pieces 2142 acting on piece IV 14 in a circumferential direction, and correspondingly, a disengaging area 217 is arranged. Specifically, the arrangement in a counterclockwise direction includes a disengaging area 217 with a sector-ring opening angle (360/14×5)° and a convex block 215 with a sector-ring opening angle (360/14×9)°.

It should be noted that a starting point in the above-mentioned counterclockwise direction is an initial point for selecting a weight. In this state, the convex blocks 215 of the dumbbell plates 10 are staggered with the positioning blocks 115 on the hanging pieces 214. That is to say, the initial point for selecting a weight is the weight of the dumbbell grip bar assembly 2.

Depending on the rotation angles of the first hanging piece 2141 and the second hanging piece 2142, the positioning block 115 can be buckled on different convex blocks 215, or can be staggered with different convex blocks 215, thereby a combination of different dumbbell plates 10 can be lifted. In the embodiment of the present application, the first hanging piece 2141 and the second hanging piece 2142 have fourteen equally divided rotation angles, i.e., the rotation angle for each time is (360/14°), which correspond to the following fourteen weight combination modes of the dumbbell plates 10:

1) No-load;
2) Two pieces I 11;
3) Two pieces II 12;
4) Two pieces I 11 and two pieces II 12;
5) Two pieces III 13;
6) Two pieces I 11 and two pieces III 13;
7) Two pieces IV 14;
8) Two pieces I 11 and two pieces IV 14;
9) Two pieces II 12 and two pieces IV 14;
10) Two pieces I 11, two piece II 12 and two pieces IV 14;
11) Two pieces III 13 and two pieces IV 14;
12) Two pieces I 11, two pieces III 13 and two pieces IV 14;
13) Two pieces II 12, two pieces III 13 and two pieces IV 14;
14) Two pieces I 11, two pieces II 12, two pieces III 13 and two pieces IV 14.

In addition, in conjunction with FIGS. 10-13, the dumbbell plates 10 can be obtained in a combination of (7) two pieces I 11 and two pieces IV 14.

Figure 15:
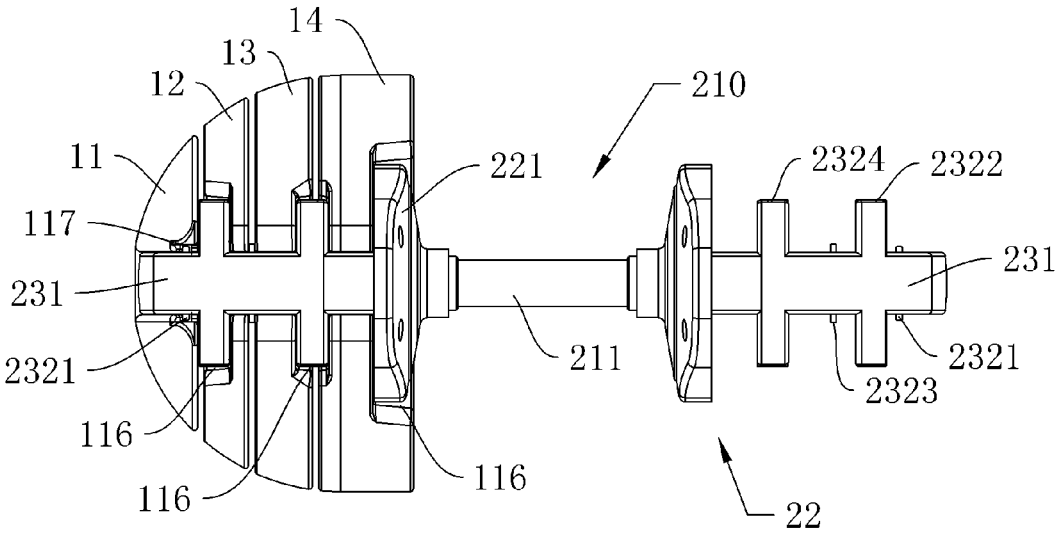
FIG. 15 is a top view of a portion of the structure of an embodiment of the present application showing the mating structure of the isolation limiting mechanism and the dumbbell plates.
Figure 16:
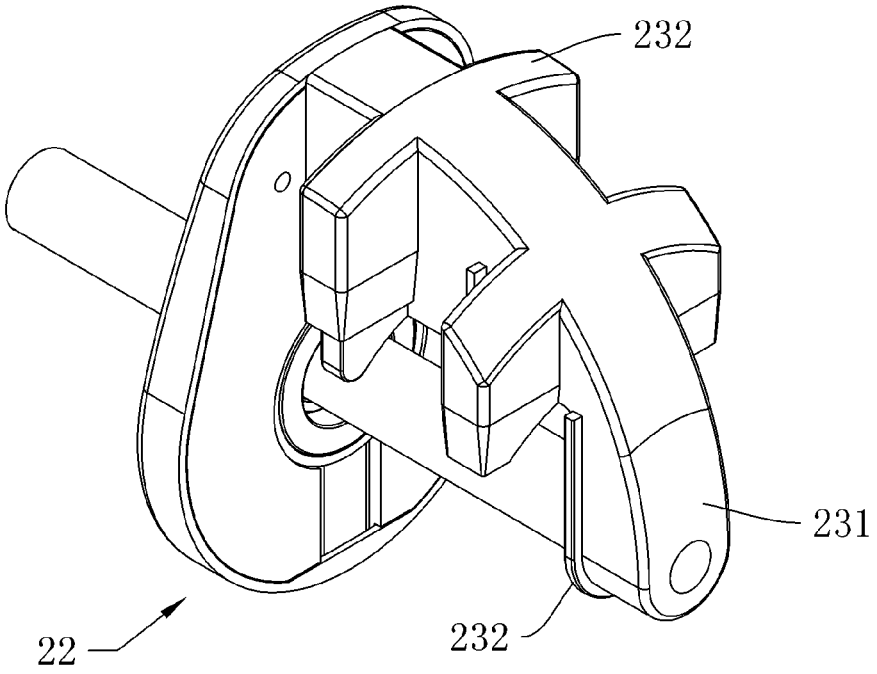
FIG. 16 is a schematic diagram of a portion of the structure of an embodiment of the present application showing the structure of the isolation limiting mechanism.

Referring to FIGS. 15 and 16, one end of the connecting block 231 is bolted to the linkage assembly 210, and the other end of the connecting block 231 is bolted to one side of the lock case 221. According to the specific arrangement of the dumbbell plates 10 in the embodiment of the present application, two sets of larger isolating blocks 232 and two sets of smaller isolating blocks 232 are respectively integrally formed on both sides of the connecting block 231. For convenience of explanation, the isolating blocks 232 are named as a first isolating block 2321, a second isolating block 2322, a third isolating block 2323, and a fourth isolating block 2324 in turn from a connection end at which the connecting block 231 is connected with the central shaft 211 to a connection end at which the connecting block 231 is connected with the lock case 221, in which the first isolating block 2321 and the third isolating block 2323 are smaller isolating blocks 232, and the second isolating block 2322 and the fourth isolating block 2324 are larger isolating blocks 232.

Referring to FIG. 16, the piece I 11 has a U-shaped fixing groove 117. The U-shaped groove 117 is arranged on an end face of piece II 12 and piece III 13 having a positioning block 115, and arranged on both end faces of piece IV 14. The first isolating block 2321 is inserted into the fixing groove 117 so as to limit the radial movement of piece I 11; the second isolating block 2322 is inserted into the U-shaped groove 117 of the piece II 12 to limit movement of piece II 12 close to piece I 11. The third isolating block 2323 is simultaneously inserted between piece II 12 and piece III 13, thereby limiting the movement of piece II 12 close to piece III 13 while limiting the movement of piece III 13 close to piece II 12. The fourth isolating block 2324 is partially inserted into the U-shaped groove 117 of piece III 13 and partially inserted into the U-shaped groove 117 of piece IV 14, thereby limiting movement of piece III 13 close to piece IV 14 while limiting movement of piece IV 14 close to piece III 13. In addition, the lock case 221 is inserted into the U-shaped groove 117 on the other end face of the piece IV 14, thereby limiting movement of the piece IV 14 away from the piece III 13.

Figure 17:
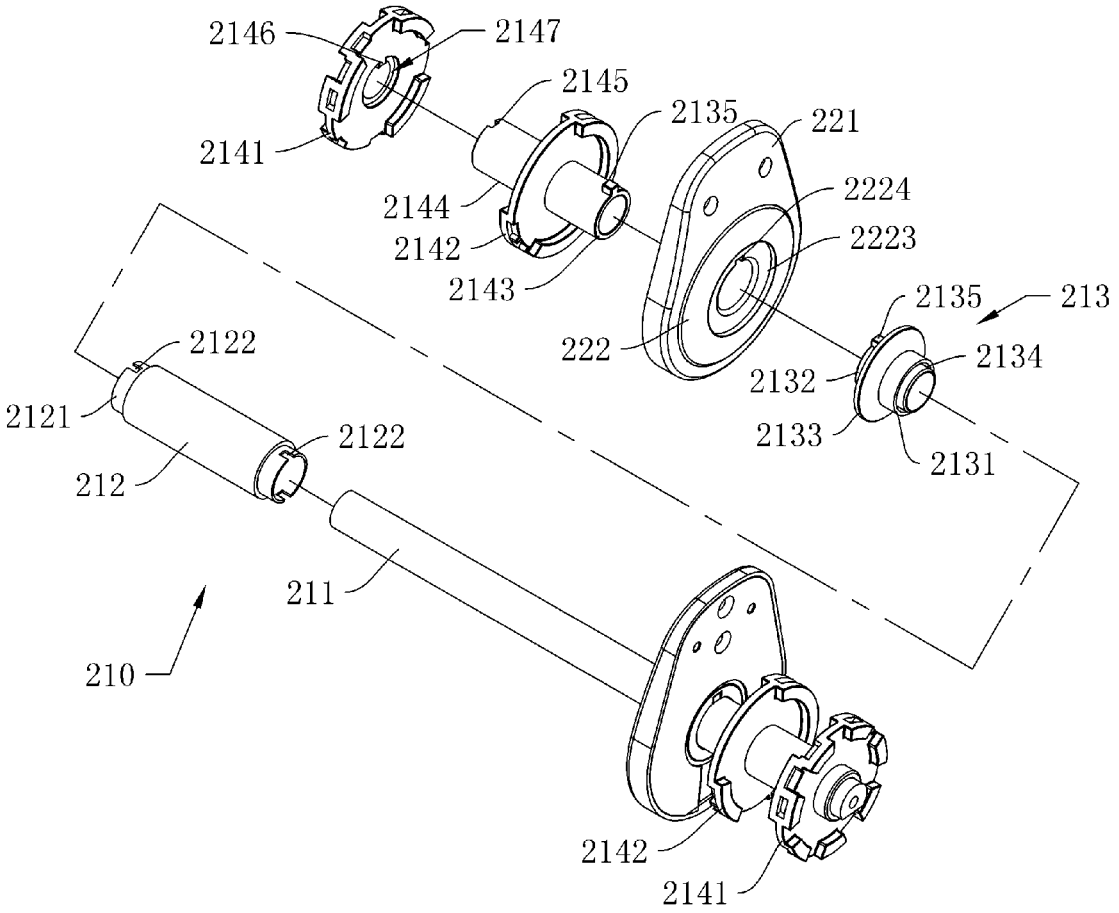
FIG. 17 is an exploded view of one perspective view of a dumbbell grip bar assembly according to an embodiment of the present application.

Referring to FIG. 17, the linkage assembly 210 includes a central shaft 211, a handle tube 212, a handle head 213, wherein the central shaft 211 is always in a relatively fixed state; the handle tube 212, the handle head 213, the stop disc 222, the second hanging piece 2142 and the first hanging piece 2141, which rotate synchronously with each other, are sequentially connected in series from the middle to both ends of the central shaft 211; the handle tube 212, the handle head 213, the stop disc 222, the second hanging piece 2142 and the first hanging piece 2141 interpenetrate to each other in the middle.

The handle tube 212 is sleeved on the middle section of the central shaft 211 and is relatively rotatably connected with the central shaft 211. A linkage convex ring 2121 is integrally formed at each of two ends of the handle tube 212, and the outer end of the linkage convex ring 2121 is provided with a linkage notch 2122.

The handle head 213 includes a linkage disc 2133, a first linkage portion 2131 and a second linkage portion 2132 that are integrally formed on two sides of the linkage disc 2133, wherein the first linkage portion 2131 is connected with the linkage convex ring 2121, and the second linkage portion 2132 is connected with the stop disc 222.

Figure 18:
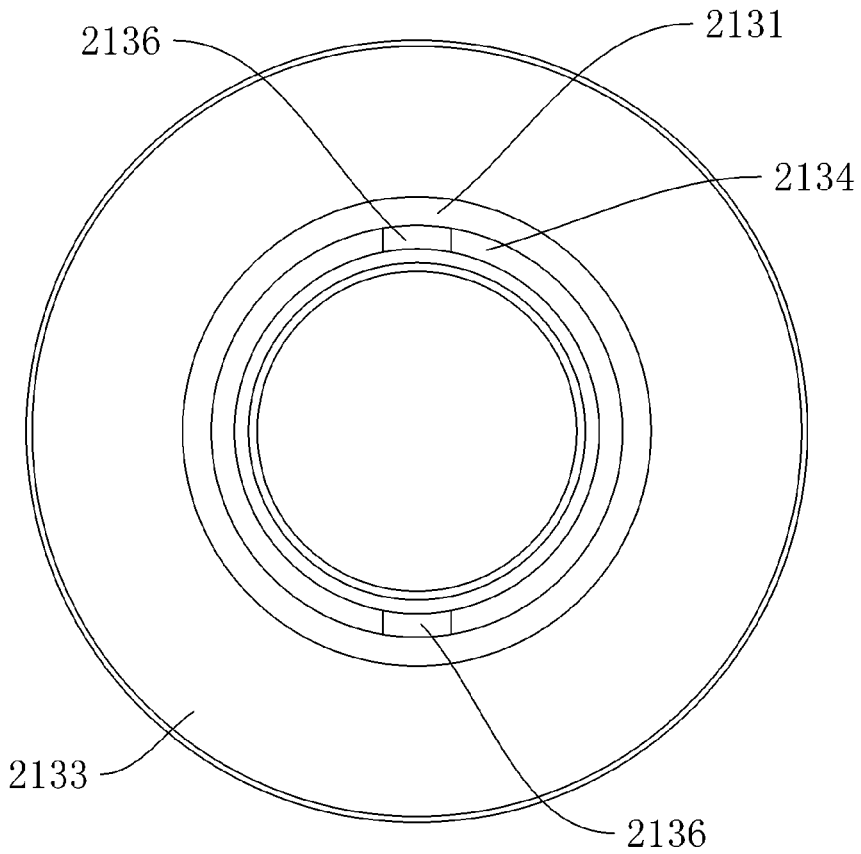
FIG. 18 is a front view of a handle head according to an embodiment of the present application showing the structure of a linkage convex block in a linkage groove.

Referring to FIGS. 17 and 18, the first linkage portion 2131 is provided with a linkage groove 2134, a linkage convex block 2136 is convexly provided in the linkage groove 2134 of the first linkage portion 2131, the linkage convex ring 2121 is inserted into the linkage groove 2134, and the linkage convex block 2136 is inserted into the linkage notch 2122, so that the handle head 213 can be driven to rotate when the handle tube 212 rotates.

Figure 19:
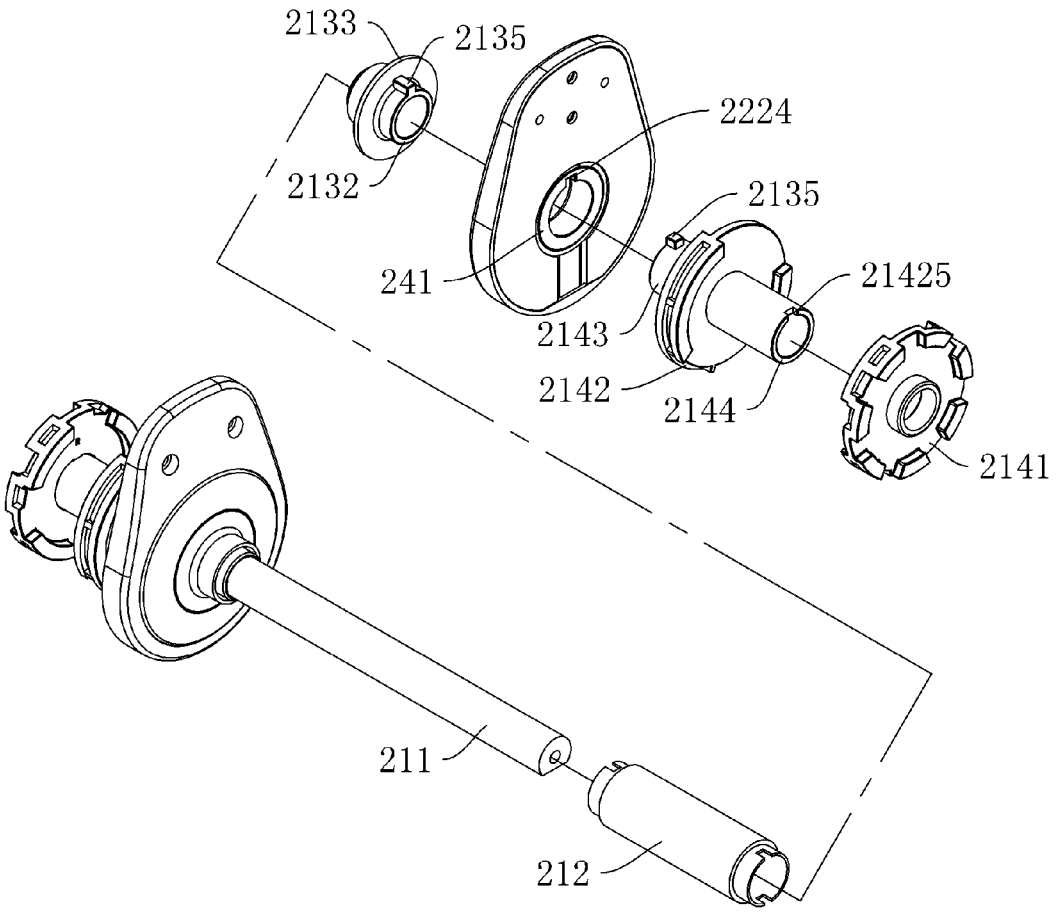
FIG. 19 is an exploded view of another perspective view of a dumbbell grip bar assembly according to an embodiment of the present application.

Referring to FIGS. 17 and 19, a groove 2223 for inserting of the linkage disc 2133 is provided in the middle of the stop disc 222; the stop disc 222 is axially provided with a key groove 2224 which simultaneously penetrates through a mounting tube 241; a linkage block 2135 is convexly provided on the outer peripheral surface of the second linkage portion 2132, and the linkage block 2135 is inserted into the key groove 2224 while the second linkage portion 2132 is inserted into the stop disc 222, so that the second linkage portion 2132 rotates to drive the stop disc 222 to rotate.

One end face of the second hanging piece 2142 is convexly provided with a first tube body 2143, the other end face of the second hanging piece is convexly provided with a second tube body 2144, wherein the first tube body 2143 is connected with the mounting tube 241, and the second tube body 2144 is connected with the first hanging piece 2141.

A linkage block 2135 is convexly provided on the periphery of the first tube body 2143, and the linkage block 2135 is inserted into the key groove 2224 while the first tube body 2143 is inserted into the mounting tube 241, so that the stop disc 222 rotates to drive the second hanging piece 2142 to rotate.

A slot 2147 for inserting of one end of the second tube body 2144 is formed in the middle of the first hanging piece 2141, a rotatory notch 2145 is formed in one end of the second tube body 2144, a rotating convex block 2146 is convexly provided in the middle of the first hanging piece 2141; the second tube body 2144 is inserted into the slot 2147, and meanwhile, the rotating convex block 2146 is inserted into the rotatory notch 2145, so that the second hanging piece 2142 rotates to drive the first hanging piece 2141 to rotate.

Figure 20:
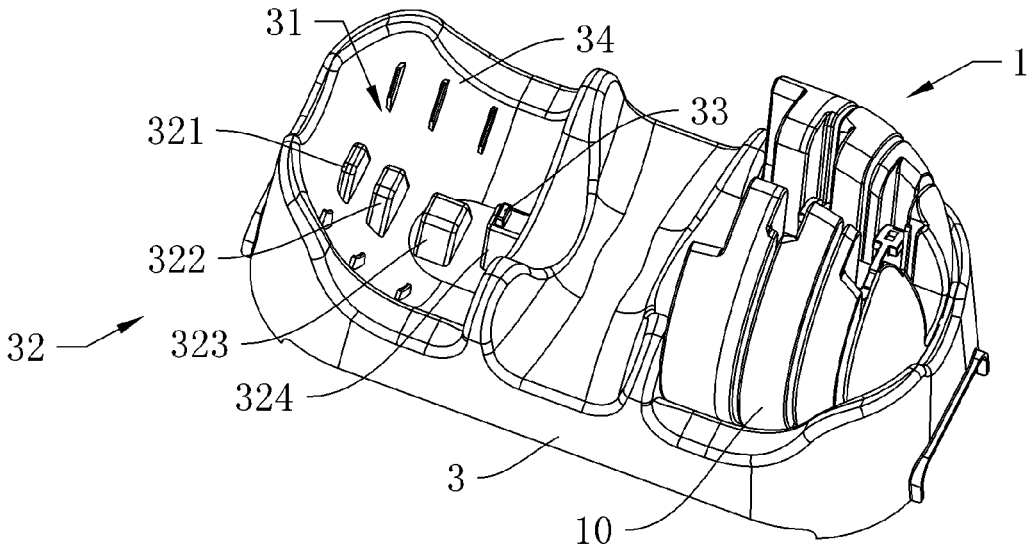
FIG. 20 is a schematic view showing the structure of a base according to an embodiment of the present application.
Figure 21:
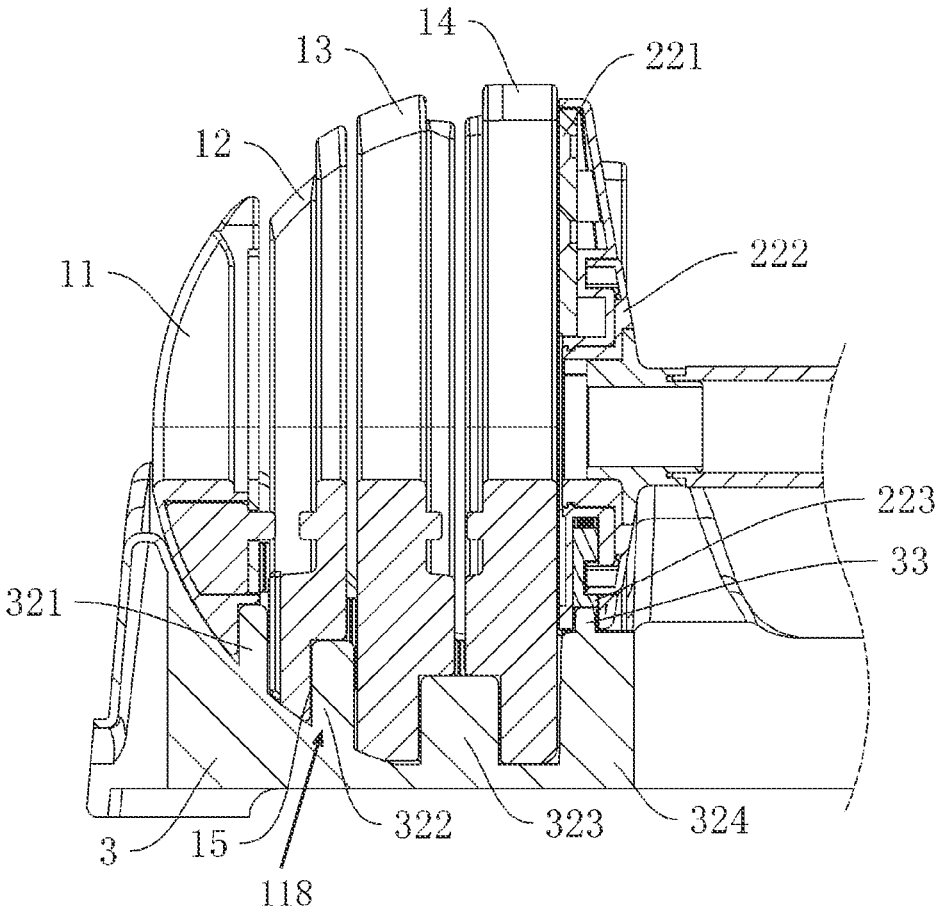
FIG. 21 is a cross-sectional view of a portion of the structure of an embodiment of the present application showing the mating of a dumbbell plate group with a base.

Referring to FIGS. 20 and 21, two ends of the dumbbell base 3 are provided with stabilizing grooves 31 for placing the dumbbell plate groups 1. The dumbbell base 3 is provided with stabilizing blocks 32 convexly provided in the stabilizing grooves 31. The bottom 118 of the dumbbell plate 10 is provided with a positioning groove 15 for inserting of a stabilizing block 32. In the embodiment of the present application, four stabilizing blocks 32 correspondingly arranged on one side of the dumbbell base 3 according to the number of the dumbbell plates 10. For convenience of explanation, the four stabilizing blocks 32 are respectively named as a first stabilizing block 321, a second stabilizing block 322, a third stabilizing block 323 and a fourth stabilizing block 324 from the end to the middle of the dumbbell base 3, which respectively correspond to piece I 11, piece II 12, piece III 13 and piece IV 14 when the dumbbell plate group 1 is placed in the stabilizing groove 31.

A top block 33 is convexly provided on the top surface of the fourth stabilizing block 324, which is located directly below the lock case 221 and corresponds to the lock head 223. When the dumbbell plate group 1 is placed in the stabilizing groove 31, the top block 33 abuts against the lock head 223, and the stop disc 222 is always unlocked.

Referring to FIG. 20, the dumbbell base 3 is provided with a plurality of auxiliary blocks 34 that are convexly provided in the stabilizing groove 31. The auxiliary blocks 34 are symmetrically distributed on both sides of the first stabilizing block 321, the second stabilizing block 322 and the third stabilizing block 323. The auxiliary blocks 34 are inserted between the adjacent dumbbell plates 10 when the dumbbell plate group 1 is placed in the stabilizing groove 31.

The implementation principle of the weight-adjustable dumbbell assembly in the present application is as follows. When the dumbbell is placed on the dumbbell base 3, the stop disc 222 is in an unlocking state, the handle tube 212 can be rotated to sequentially drive the handle head 213, the stop disc 222, the first hanging piece 2141 and the second hanging piece 2142 to synchronously rotate; and according to the rotation angles of the first hanging body 21411 and the second hanging body 21421, the positioning block 115 is buckled with different convex blocks 21416 to lift different combinations of the dumbbell plates 10.

When the dumbbell is lifted, the elastic member 224 is reset, the stop disc 222 is in a locking state, in which the stop disc 222 cannot rotate, and the handle tube 212 cannot rotate, such that the dumbbell plate 10 is prevented from being disengaged from the hanging piece, and the user is safer in exercise.

The above are all preferred examples of the present application and are not intended to limit the scope of the present application. Therefore, all equivalent changes made in accordance with the structures, shapes and principles of the present application shall be comprised in the scope of protection of the present application.

LIST OF REFERENCE NUMERALS

1, dumbbell plate group; 10, dumbbell plates; 11, piece I; 12, piece II; 13, piece III; 14, piece IV; 15, positioning groove; 115, positioning block; 116, positioning hole; 117, U-shaped groove;

2, dumbbell grip bar assembly;

21, rotary plate selecting mechanism; 210, linkage assembly; 211, central shaft; 212, handle tube; 213, handle head; 214, hanging pieces; 215, convex block; 216, limiting area; 217, disengaging area; 2141, first hanging piece; 2142, second hanging piece;

2121, linkage convex ring; 2122, linkage notch; 2131, linkage portion I; 2132, linkage portion II; 2133, linkage disc; 2134, linkage groove; 2136, linkage convex block; 2135, linkage block; 2143, first tube body; 2144, second tube body; 2147, slot; 2145, rotatory notch; 2146, rotatory convex block;

22, safety stop mechanism; 221, lock case; 222, stop disc; 223, lock head; 224, elastic element; 240, accommodating groove; 241, mounting tube; 225, stop block; 226, stop notch; 242, mounting hole; 243, fixture block; 244, annular groove; 2231, connecting portion; 2232, abutment portion; 2233, trigger portion; 2234, relief groove; 2223, groove; 2224, key groove;

23, isolation limiting mechanism; 231, connecting block; 232, isolating block; 2321, first isolating block; 2322, second isolating block; 2323, third isolating block; 2324, fourth isolating block;

3, dumbbell base; 31, stabilizing groove; 32, stabilizing block; 321, first stabilizing block; 322, second stabilizing block; 323, third stabilizing block; 324, fourth stabilizing block; 33, top block; 34, auxiliary block.

What is claimed is:

1. A weight-adjustable dumbbell, comprising a dumbbell grip bar assembly (2) and dumbbell plate groups (1) connected to two ends of the dumbbell grip bar assembly (2), wherein each of the dumbbell plate groups (1) comprises at least two dumbbell plates (10), and the dumbbell grip bar assembly (2) comprises a rotary plate selecting mechanism (21) for releasing or selecting at least one of the dumbbell plates (10) of each of the dumbbell plate groups (1); wherein the rotary plate selecting mechanism (21) comprises a central shaft (211), a handle tube (212) rotatably connected to the central shaft (211), and at least one hanging piece (214) rotatably connected to the central shaft (211), the at least one hanging piece (214) rotates synchronously with the handle tube (212);

the dumbbell grip bar assembly (2) further comprises a safety stop mechanism (22), the safety stop mechanism (22) comprises a stop disc (222) and a lock head (223), the stop disc (222) rotates relative to the central shaft (211), the stop disc (222) rotates synchronously with the handle tube (212), and the lock head (223) is configured for unlocking/locking rotation of the stop disc (222);

the safety stop mechanism (22) further comprises a lock case (221) fixed with the central shaft (211), a mounting tube (241) is convexly provided in the middle of the stop disc (222), a mounting hole (242) for inserting of the mounting tube (241) is formed in the middle of the lock case (221); at least one deformable fixture block (243), is convexly provided on a hole wall of the mounting hole (242) of the lock case (221); and an annular groove (244) for clamping of the at least one deformable fixture block (243) is provided on the periphery of the mounting tube (241).

2. The weight-adjustable dumbbell of claim 1, a convex block (215) is convexly provided on the at least one hanging piece (214), the convex block (215) and the at least one hanging piece (214) form a limiting area (216) and a disengaging area (217), each of the at least two dumbbell plates (10) of each of the dumbbell plate groups (1) is provided with a positioning block (115), the positioning block (115) is able to slide into the limiting area (216) and be buckled with the convex block (215), and the positioning block (115) is able to slide into the disengaging area (217) and be staggered with the convex block (215).

3. The weight-adjustable dumbbell of claim 2, wherein the safety stop mechanism (22) further comprises the lock head (223) slidably connected to the lock case (221); the stop disc (222) is rotatably connected with the lock case (221), a plurality of stop blocks (225) are arranged on one end face of the stop disc (222) in a circumferential direction at intervals, and stop notches (226) for inserting of the lock head (223) are formed between adjacent stop blocks (225).

4. The weight-adjustable dumbbell of claim 3, wherein the safety stop mechanism (22) further comprises an elastic member (224) that always forces the lock head (223) to have a movement tendency of inserting into one of the stop notches (226).

5. A dumbbell assembly, comprising the weight-adjustable dumbbell of claim 4 and a dumbbell base (3) for placing the weight-adjustable dumbbell.

6. The dumbbell assembly of claim 5, wherein the dumbbell base (3) is convexly provided with a top block (33), the top block (33) abuts against the lock head (223), and the lock head (223) is staggered with each of the stop notches (226).

7. The dumbbell assembly of claim 6, wherein the dumbbell base (3) is convexly provided with a plurality of stabilizing blocks (32), a bottom (118) of each of the at least two dumbbell plates (10) of each of the dumbbell plate groups (1) is provided with a positioning groove (15) for inserting of one of the plurality of stabilizing blocks (32).

8. The weight-adjustable dumbbell of claim 3, wherein the dumbbell grip bar assembly (2) further comprises an isolation limiting mechanism (23), the isolation limiting mechanism (23) comprises a connecting block (231) and a plurality of isolating blocks (232), one end of the connecting block (231) is connected with the lock case (221), another end of the connecting block (231) is connected with the central shaft (211) in a coupling manner, and the plurality of isolating blocks (232) are convexly provided on two sides of the connecting block (231) and are provided for separating any two adjacent dumbbell plates (10) of the at least two dumbbell plates (10) of each of the dumbbell plate groups (1).

9. A dumbbell assembly, comprising the weight-adjustable dumbbell of claim 8 and a dumbbell base (3) for placing the weight-adjustable dumbbell.

10. The dumbbell assembly of claim 9, wherein the dumbbell base (3) is convexly provided with a top block (33), the top block (33) abuts against the lock head (223), and the lock head (223) is staggered with each of the stop notches (226).

11. The dumbbell assembly of claim 10, wherein the dumbbell base (3) is convexly provided with a plurality of stabilizing blocks (32), a bottom (118) of each of the at least two dumbbell plates (10) of each of the dumbbell plate groups (1) is provided with a positioning groove (15) for inserting of one of the plurality of stabilizing blocks (32).

12. A dumbbell assembly, comprising the weight-adjustable dumbbell of claim 3 and a dumbbell base (3) for placing the weight-adjustable dumbbell.

13. The dumbbell assembly of claim 12, wherein the dumbbell base (3) is convexly provided with a top block (33), the top block (33) abuts against the lock head (223), and the lock head (223) is staggered with each of the stop notches (226).

14. The dumbbell assembly of claim 13, wherein the dumbbell base (3) is convexly provided with a plurality of stabilizing blocks (32), a bottom (118) of each of the at least two dumbbell plates (10) of each of the dumbbell plate groups (1) is provided with a positioning groove (15) for inserting of one of the plurality of stabilizing blocks (32).

15. The weight-adjustable dumbbell of claim 1, wherein a plurality of dumbbell plates (10) in one of the dumbbell plate groups (1) have different weights.

16. The weight-adjustable dumbbell of claim 15, wherein a convex block (215) is convexly provided on the at least one hanging piece (214), the convex block (215) and the at least one hanging piece (214) form a limiting area (216) and a disengaging area (217), each of the at least two dumbbell plates (10) of each of the dumbbell plate groups (1) is provided with a positioning block (115), the positioning block (115) is able to slide into the limiting area (216) and be buckled with the convex block (215), and the positioning block (115) is able to slide into the disengaging area (217) and be staggered with the convex block (215).

* * * * *